US005540156A

United States Patent [19]

Fong

[11] Patent Number: 5,540,156

[45] Date of Patent: Jul. 30, 1996

[54] SELECTABLE EFFECTS EXPLOSIVELY FORMED PENETRATOR WARHEAD

[75] Inventor: Richard Fong, Rockaway, N.J.

[73] Assignee: The United States of America as represented by the Secretary of the Army, Washington, D.C.

[21] Appl. No.: 387,060

[22] Filed: Dec. 5, 1994

Related U.S. Application Data

[63] Continuation-in-part of Ser. No. 106,836, Aug. 16, 1993, abandoned.

[51] Int. Cl.[6] ..... F42B 12/10

[52] U.S. Cl. ..... 102/476; 102/306; 102/501

[58] Field of Search ..... 102/305–310, 102/475–476, 491–497, 501

[56] References Cited

U.S. PATENT DOCUMENTS

| | | | |
|---|---|---|---|
| 3,156,188 | 11/1964 | Zernow et al. | 102/491 |
| 3,799,054 | 3/1974 | La Rocca | 102/491 |
| 3,820,464 | 6/1974 | Dixon | 102/493 |
| 4,649,828 | 3/1987 | Henderson et al. | 102/476 |
| 4,776,272 | 10/1988 | Lindstadt et al. | 102/307 |
| 4,784,062 | 11/1988 | Rudolf et al. | 102/476 |
| 5,229,542 | 7/1993 | Bryan et al. | 102/491 |

FOREIGN PATENT DOCUMENTS

| | | | |
|---|---|---|---|
| 573078 | 11/1945 | United Kingdom | 102/476 |

*Primary Examiner*—Harold J. Tudor
*Attorney, Agent, or Firm*—Anthony T. Lane; Edward Goldberg; Michael C. Sachs

[57] ABSTRACT

An apparatus and method for producing a selectable effects explosively formed penetrator warhead having the ability to defeat either single armored targets or a multiplicity of lightly armored targets.

8 Claims, 4 Drawing Sheets

SELECTABLE EFFECTS EXPLOSIVELY FORMED PENETRATOR WARHEAD

GOVERNMENT INTEREST

The invention disclosed herein may be manufactured, used and licensed by or for the United States Government.

This application is a continuation-in-part of application Ser. No. 08/106,836, filed on Aug. 16, 1993 now abandoned.

BACKGROUND OF THE INVENTION

In modern warfare the success of a mission is frequently dependent upon using the proper munition against the intended target. Munitions which use shaped charges having a single massive high velocity penetrator may be suitable against an armored vehicle such as a tank or armored personnel carrier, but ineffective against light, dispersed targets such as a group of trucks, supply vehicles, missile launchers or communication stations. In the past, an aircraft armed with a multiplicity of weapons to meet a variety of targets meant a possible loss of ability to counter a threat larger than anticipated of one particular kind. The high cost of guided missiles makes it extremely important that the warhead be suitable for defeating the intended target and having the capability of quickly and selectively changing the shape of the warhead's penetrating pattern. There are presently artillery fired target seeking munitions having applications requiring the ability to select to project either a single penetrator or a number of small penetrators or fragments spread out in a controlled pattern.

Prior art devices have tried to solve this problem of selectable effects through the use of different or multiple initiation points for the shape charge munition. The complex shape of the detonation wave produced was intended to interact with the liner causing it to break up into a number of individual fragments. The problem with this approach is that it requires a relatively complex initiation scheme. A simpler approach was therefore sought and may be found in the present invention hereinafter described.

SUMMARY OF THE INVENTION

The present invention relates to an apparatus and method that allows selection of two or more effect when an explosively formed penetrator (EFP) warhead is detonated.

An object of the present invention is to provide a mechanical method for an explosively formed penetrator (EFP) which utilizes two or more rod networks mounted in an overlapping pattern to allow production of more than one controlled fragment size.

Another object of the present invention is to provide a rod array for an EFP which allows production of a multiplicity of fragment sizes.

Another object of the present invention is to provide a mechanical selection device for an EFP that is simple to manufacture, inexpensive and adaptable to almost any warhead design.

A further object of the present invention is to provide an EFP system that is effective against armored targets, such as tanks, armored personnel carriers and light armored targets such as trucks, missile launchers, and communication stations.

For a better understanding of the present invention, together with other and further objects thereof, reference is made to the following description taken in connection with the accompanying drawings.

BRIEF DESCRIPTION OF THE DRAWINGS

Throughout the following description like reference numerals are used to denote like parts of the drawings.

DETAILED DESCRIPTION OF THE PREFERRED EMBODIMENTS

Figure 3:
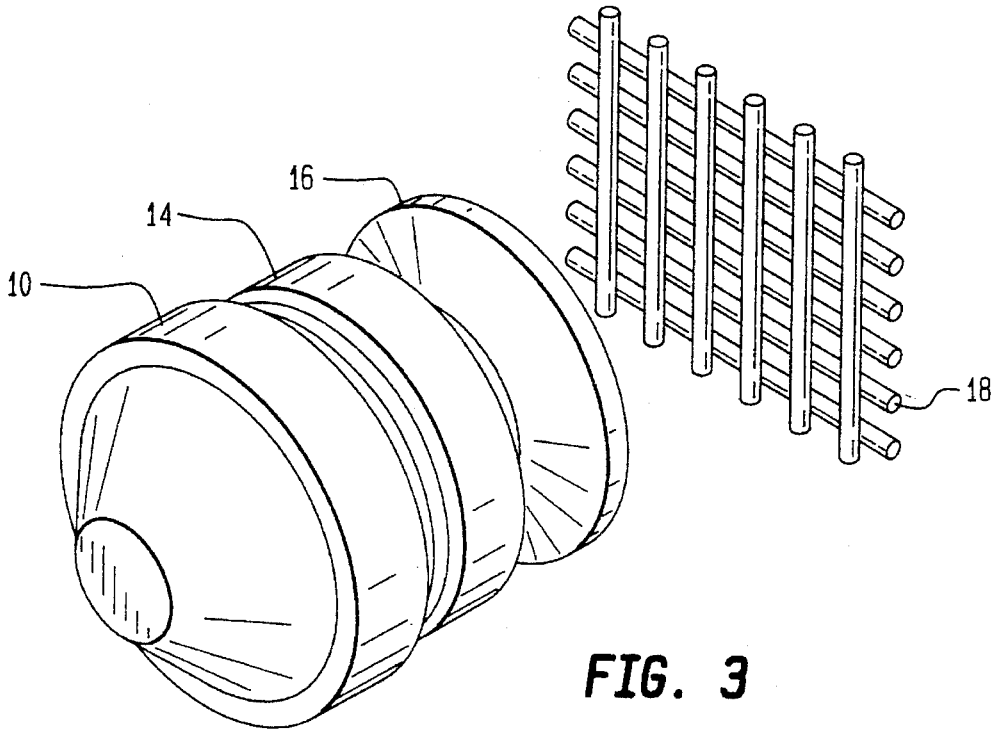
FIG. 3 is an exploded view of a typical selectable effects EFP warhead.
Figure 1:
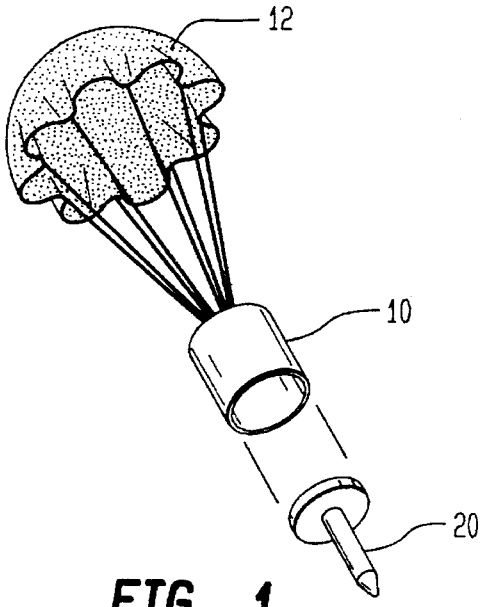
FIG. 1 is an isometric view of a parachute delivered selectable effects warhead munition showing a long rod explosively formed penetrator suitable for defeating armored targets and where a multipenentator rod network has been discarded prior to activation.
Figure 2:
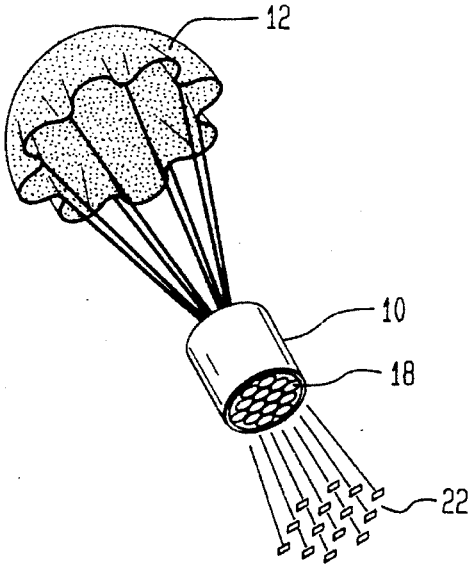
FIG. 2 is an isometric view of a parachute delivered selectable effects warhead munition showing a multiple explosively formed penetrators suitable for defeating light armed targets.

Referring now to FIGS. 1–3 a metal cylindrically cup-shaped housing 10 is supported by a parachute 12 which has been ejected by a carrier, not shown, to the target area. The housing 10 contains therein a cylindrically shaped explosive charge 14 such as octol. A round metal liner plate 16 is operatively disposed intermediate the explosive charge 14 and a mechanically selectively positioned rod array 18. FIG. 1 illustrates the application where multipenetrator rod network 18 has been discarded so that the munition when fired will produce a single high velocity rod shaped penetrator 20 capable of penetrating and defeating armored targets. FIG. 2 illustrates the application where the multipenetrator rod network 18 has not been discarded so that the munition when fired will propel the liner 16 through the rod array 18 producing a pattern of high velocity multiple explosively formed penetrator 22.

Figure 4:
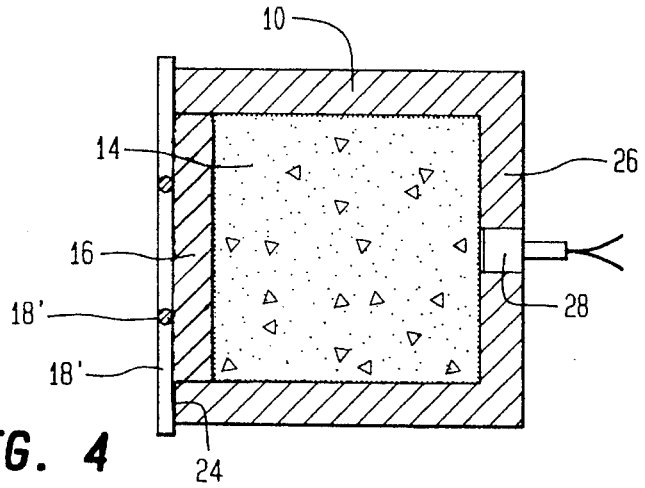
FIG. 4 is a cross-sectional view of an EFP warhead with a rod array in place, taken along line 1—1 of FIG. 5.
Figure 5:
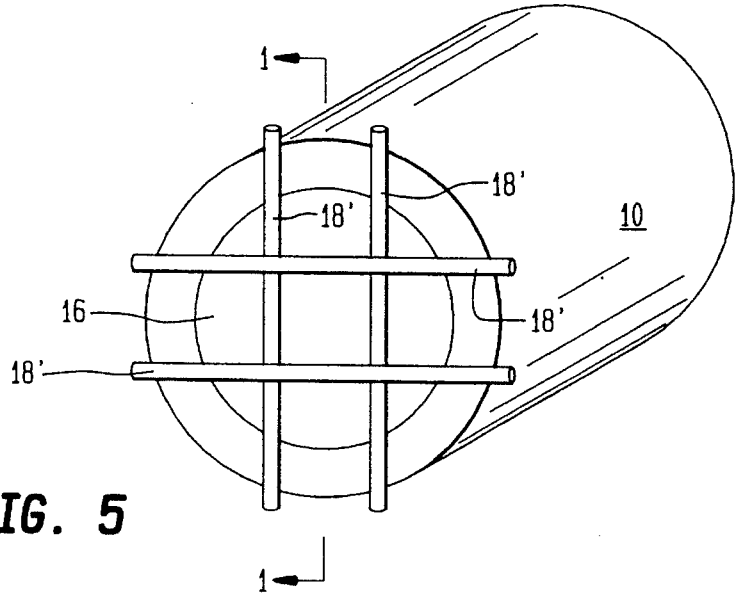
FIG. 5 is an isometric view of an EFP warhead with a rod array in place.

Referring now to FIGS. 4 and 5, the major components comprise the circular copper plate liner 16 positioned between the octol explosive charge 14 and the rod array 18 removably located on the open front end 24 of housing 10. The rear housing closed and 26 has an axially positioned detonator 28 located therein for initiating the explosive.

In operation when the explosive 14 is initiated by the detonator 28 it detonates causing the liner 16 to be accelerated in the direction opposite the ignition point. If the rod array 18 is not present, as shown in the FIG. 1 application, the plate liner 16 is formed into a single penetrator 20. If however, the rod array 18 is in place as shown in FIGS. 2–5, the liner 16 contacts the rod array 18 in the early stages of its motion. The inertia of the rod array 18 causes the plate liner 16 to break up along the lines of the rods 18' into a number of discrete fragments. For the example in FIGS. 4 and 5 the number of fragments produced would be nine. Two or more rod networks may be mounted in an overlapping pattern to allow production of more than one controlled fragment size for specific applications. Careful design of the rod array 18 allows production of almost any size fragment. The network of rods 18 is removed prior to warhead functioning when the normal EFP single penetrator formation is desired.

Figure 6:
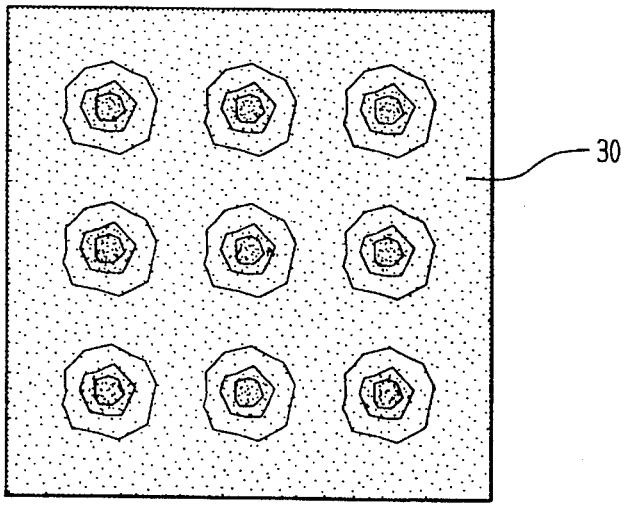
FIG. 6 is a target plate showing the fragmentation pattern of a rod array shown in FIG. 5.
Figure 7:
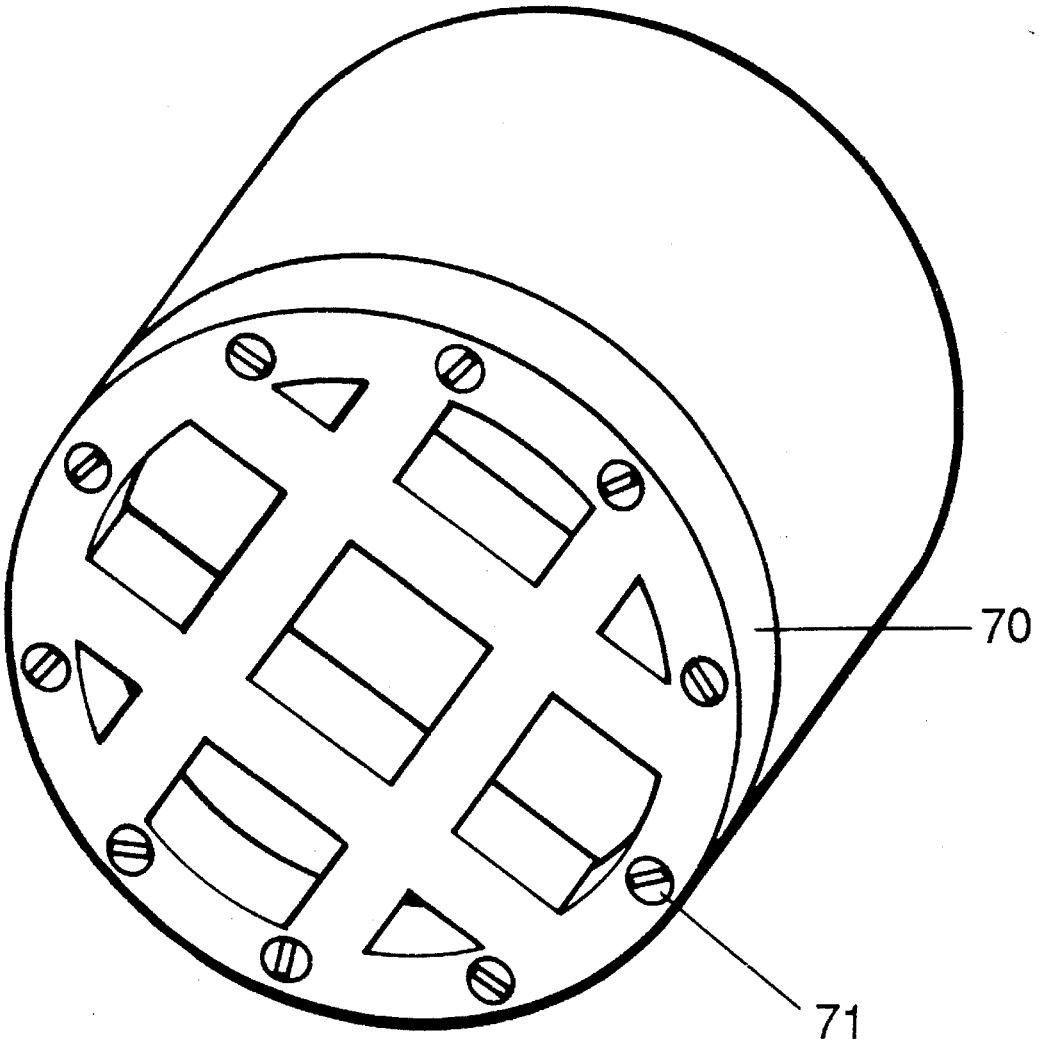
FIG. 7 shows an EFP warhead with a (detachable) screen array, to replace the rod array shown in FIG. 5.
Figure 8:
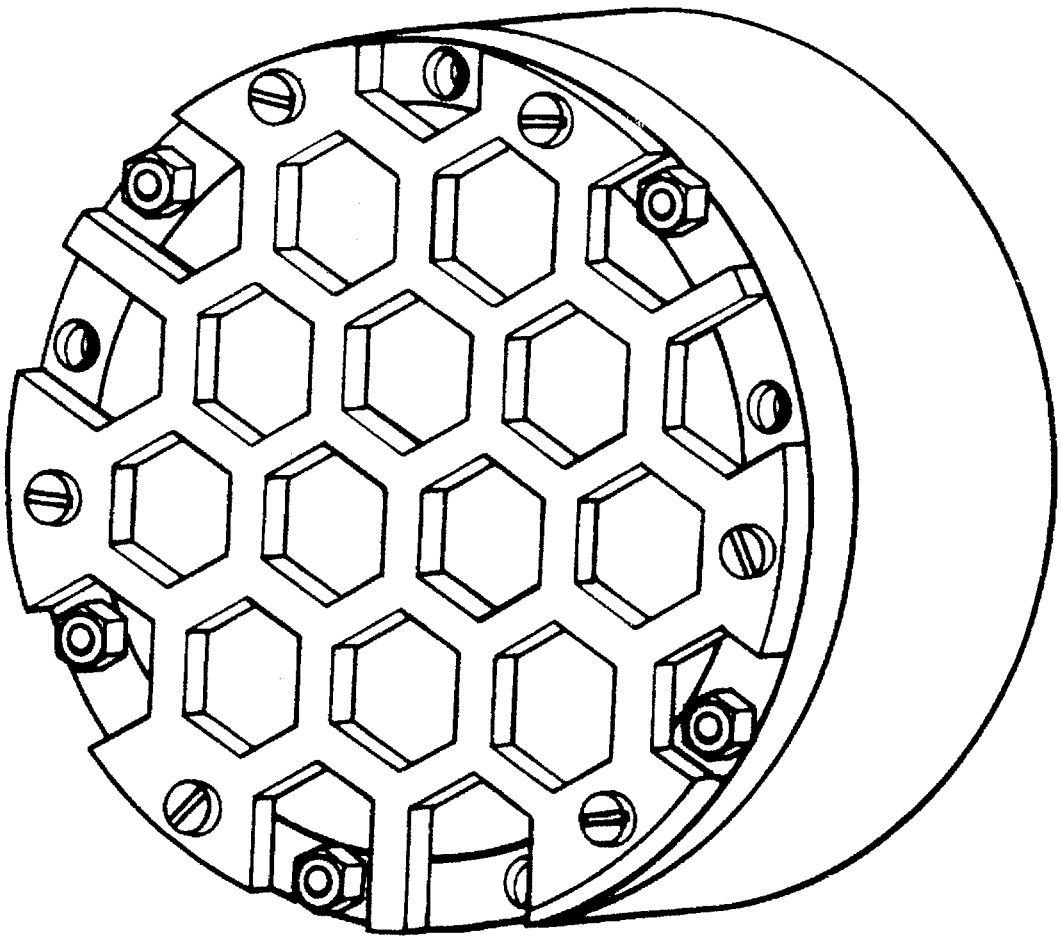
FIG. 8 shows a device like in FIG. 7 except that the screen array is a honeycomb pattern.

FIG. 6 illustrates the pattern produced on a one-inch aluminum target plate 30 by the impact of fragments from the liner of a test warhead similar to that illustrated in 5. In the test, the plate was located four feet in front of the test warhead. The octol explosive charge in the test warhead, not shown, was 2.5 inches in diameter and 2.5 inches high. The network of rods (70) shown in FIG. 7 may be removed by detaching the screws or bolts shown there (71). It is considered possible to have the rod array removed, in-flight, (when desired) upon radio signal command to activate explosives which will cut such screws or bolts. The rod array plate will then quickly become detached in flight. Such system would eliminate need to physically remove the rod arrays from each warhead, when a mission requires single penetrator formations. Also, it allows a mission to be changed at, or delayed to, the last minute, in combat, without returning to base for changes. FIG. 8 shows a different possible pattern for the rod array, where the pattern is honeycomb in shape.

The concept of employing an array of rods or wires to control the fragmentation of a warhead component can also be applied to other warhead configurations. For example, wrapping a wire screen around the surface of a cylindrical warhead can control the fragmentation of the side wall.

While a specific embodiment of the invention has been shown and described in detail to illustrate the application of the principles of the invention, it will be understood that the invention may be embodied otherwise without departing from said principles.

What is claimed is:

1. A warhead for generating an explosively formed penetrator, said warhead having a housing comprising a singular circular liner which is deformed and propelled by explosive charges in the housing, said warhead including a device for dividing an active said explosively formed penetrator in motion into several, smaller sized explosively formed penetrators in motion, said device comprising:

a screen means comprising a first flat array of parallel straight metal rods which are joined to a second flat array of parallel straight second metal rods each of which second rods is perpendicular to a rod in said first flat array and in the plane of said first flat array, said screen means being attached by screws to said housing, in juxtaposition to said liner means, said screws being removable to remove said screen means, whereby said screen means divides an active explosively formed penetrator while same is in flight, but the explosively formed penetrator continues intact by removing the screen by unscrewing same prior to detonation of said warhead.

2. The warhead as in claim 1 wherein said housing is of cup-shaped metal.

3. The warhead as in claim 2 wherein the liner is a circular copper plate.

4. The warhead as in claim 3 wherein the explosive charges comprise octol explosive.

5. The warhead as in claim 4 wherein some of the divided explosively formed penetrators are of different sizes, of cross-sectional area proportional to the cross-sectional area sizes of the corresponding openings in said screen formed by intersections of the rods.

6. The warhead as in claim 5 wherein the divided explosively formed penetrators are all of approximately equal size when the screen has rods that are all equally spaced.

7. The warhead as in claim 1 wherein the rods in said first flat array are equally spaced, and the rods in said second flat array are equally spaced.

8. The warhead as in claim 1 wherein the number of rods in said first flat array is two, and the number of rods in said second flat array is two.

* * * * *